United States Patent [19]

Hedges

[11] 3,963,095

[45] June 15, 1976

[54] AUXILIARY EXTENSION PLATFORM ASSEMBLY SUPPORT FRAME DRIVE MEANS FOR AN AERIAL LADDER ASSEMBLY

[75] Inventor: Melvin R. Hedges, Littlestown, Pa.

[73] Assignee: Cam Industries, Inc., Hanover, Pa.

[22] Filed: Dec. 11, 1974

[21] Appl. No.: 531,536

[52] U.S. Cl. ..... 182/2
[51] Int. Cl.[2] ..... B66F 11/04
[58] Field of Search ..... 182/2, 141, 148

[56] References Cited

UNITED STATES PATENTS

| | | | |
|---|---|---|---|
| 3,596,976 | 8/1971 | Eitel | 182/2 |
| 3,608,671 | 9/1971 | Ashworth | 182/2 |
| 3,708,037 | 1/1973 | Tranchero | 182/2 |
| 3,710,893 | 1/1973 | Hippach | 182/2 |
| 3,767,007 | 10/1973 | Garnett | 182/2 |
| 3,834,488 | 9/1974 | Grove | 182/2 |

FOREIGN PATENTS OR APPLICATIONS

| | | | |
|---|---|---|---|
| 2,058,592 | 11/1970 | Germany | 182/2 |
| 550,896 | 11/1956 | Italy | 182/2 |

*Primary Examiner*—Reinaldo P. Machado
*Attorney, Agent, or Firm*—C. Hercus Just; Samuel M. Learned, Jr.

[57] ABSTRACT

A vehicular mounted, multiply-articulated aerial lift and ladder assembly comprised of a terminally affixed and partially enclosed platform member pivotally connected to a linked parallel bar assembly having a ladder section as the outward longitudinal element thereof, wherein the linked parallel bar assembly is in turn pivotally connected to the uppermost end of the extension member of a vertically displaceable dual-membered main extension ladder assembly which at the lower end thereof is pivotally attached to a horizontally rotatable platform affixed to a supporting structure upon the vehicle, the entire combined aerial lift and ladder assembly heretofore described having displacement powering means entirely operable from a control panel within the platform member, whereby a person occupying the platform may accurately position and maintain himself in an extended aerial work location within the horizontally oriented platform member. Design features of the aerial lift and ladder assembly incorporate both automatic and motor powered horizontal levelling provisions for the platform member.

3 Claims, 7 Drawing Figures

AUXILIARY EXTENSION PLATFORM ASSEMBLY SUPPORT FRAME DRIVE MEANS FOR AN AERIAL LADDER ASSEMBLY

BACKGROUND OF THE INVENTION

The instant invention relates to an auxiliary extension member and support frame for a vehicular mounted aerial ladder assembly.

Vehicular mounted ladders, towers, and aerial lift means of various types are generally disclosed in the prior art as being comprised of the following major design types. First, ladder or tower aerial lift assemblies are exemplified by those such as taught in U.S. Pat. No. 2,936,848 to Hall, dated May 17, 1960, as well as U.S. Pat. No. 3,489,244 to Rickrode et al., dated Jan. 13, 1970, and U.S. Pat. No. 3,621,935 to Bode, dated Nov. 23, 1971. The elevation and lifting means disclosed in the aforementioned patents range from manually operable to motorized aerial lift units which were primarily designed for use by utility line installers and maintenance personnel for erecting and repairing overhead electrical transmission lines and the like, in addition to being employed by tree trimming crews, as well as construction workers and painters in accomplishing various elevated operations. As further exemplified by the aforementioned patents, said ladder or tower aerial lift assemblies may also have affixed thereto, at the uppermost terminal end thereof, a work platform which may be stationary, as shown in Bodie, or arcuately adjustable with regard to maintaining a parallel relation to the horizontal plane, as shown in Hall, or, as shown in Rickrode et al, have no platform at all.

A second general type of aerial lift design are those primarily comprised of a "boom and bucket" assembly, which may or may not be vehicular mounted, and may or may not incorporate ladder features, exemplary disclosures of which are as shown in U.S. Pat. No. 3,584,703 to Lane, dated June 15, 1971, U.S. Pat. No. 3,625,307 to Siefermann et al, dated Dec. 7, 1971, and U.S. Pat. No. 3,777,845 to Ashworth, dated Dec. 11, 1973. Bucket levelling features are also normally incorporated, generally comprised of either a hydraulically activated mechanical lever assembly operable through a series of pivot points, or secondly, simple gravitational levelling means provided by pivotal suspension of said bucket from the upper end of said boom either with or without bucket stabilizing means. Aerial lift equipment of this second general design is usually larger in size and more expensive than the first general type heretofore described, and is primarily and popularly employed in fire fighting and rescue operation types of activities.

Other aerial lift means disclosures, which may be classified in one or the other categories of the two main general designs heretofore indicated, but which teach additional aspects of the art not otherwise shown, include the following: U.S. Pat. No. 2,666,417 to Harsch, dated Jan. 19, 1954, which shows a rotatably and arcuately positionable hydraulically operated two member telescopic boom having a man-carrying cage pivotally affixed to the upper terminal end thereof, whereby said cage is maintained in a horizontal configuration by means of a double-acting hydraulic motor linkably connecting said cage and the upper terminal end of said boom so that as the boom operates said motor automatically extends and retracts a piston in direct relation to the tilt of the boom, and said cage is thereby automatically maintained in a horizontally level position. A subsequent disclosure by Harsch, in U.S. Pat. No. 2,786,723 dated Mar. 26, 1957, shows a similar structure to his earlier disclosure cited supra, but teaching a new method of employing a hydraulic cylinder unit to correlate the horizontal configuration of the cage with the pivotal movements of the boom such that said cage is automatically maintained in a level disposition at all angular articulations of said boom. Another disclosure in the aerial lift art teaching less sophisticated employment of a hydraulic piston to maintain a horizontally level cage configuration is that as shown in U.S. Pat. No. 2,724,620 to Johnson et al., dated Nov. 22, 1955.

The disclosure set forth in U.S. Pat. No. 2,815,250 to Thornton-Trump, dated Dec. 3, 1957, shows an aerial lift device comprised to two pivotally connected boom sections whereby a 180° horizontally arcuate deflection capability is substantially provided for the man-carrying cage assembly pivotally affixed to the upper terminal end of the second boom section thereof, with a bell crank linkage extending from the boom structure junction to the cage through which said cage is maintained essentially in a horizontal position irrespective of the swinging movement of said booms. The disclosure by Garnett, in U.S. Pat. No. 3,196,979 dated July 27, 1965, shows means for controlling horizontal position of a man-carrying basket member pivotally affixed by means of a yoke to the end of a telescoping boom, but additionally shows a novel arrangement whereby the basket carrying arm members of the aerial lift device yoke are also pivotal rearwards whereby the transport position is one in which said basket member and yoke are folded back and said basket member rests in a stowed position upon the inner telescoping boom section. In U.S. Pat. No. 3,332,513 to Weibe, dated July 25, 1967, a mobile scaffold is shown wherein the cage member thereof remains substantially horizontal by means of a set of double-bar/double-arm linkages.

The art disclosed by Hall in U.S. Pat. No. 3,572,467 dated Mar. 30, 1971, shows a vehicular mounted telescopically extensible ladder assembly with a personnel platform pivotally affixed thereto and linkably interaffixed to a slave piston and cylinder unit whereby said platform may be stabilized or swung. Hall also teaches stowing of the retracted aerial unit rearward in the transport vehicle. A similar disclosure by, Garnett, in U.S. Pat. No. 3,767,007 dated Oct. 23, 1973, shows a pivotally mounted basket member affixed to the upper terminal end of an extensible ladder, but with the aerial unit facing vehicularly forward in the retracted stowed transport configuration, and a shock absorber type of assembly provided as a damping means to prevent sudden changes in said basket member configuration when said aerial unit is operably positioned.

Two additional disclosures showing aerial lift features of considerable interest are those set forth in U.S. Pat. No. 3,625,304 to Siefermann et al, dated Dec. 7, 1971, and the other being U.S. Pat. No. 3,710,893 to Hippach, dated Jan. 16, 1973. The Siefermann et al. disclosure shows a vehicular mounted aerial ladder assembly with a pivotally affixed cage at the upper end thereof, whereby either an electric or hydraulic power source located on the ladder provides means to automatically maintain said cage in an upright configuration relative to the horizontal position regardless of any change in incline of said aerial ladder assembly. The Hippach patent, however, shows an extendible boom and ladder assembly with a pivoted basket depending from a yoke extension affixed to the end of said boom, and further having a relatively short two-section ingress and egress ladder leading from the upper end of the main ladder into the pivotally depending basket.

It should be understood that some of the features of the instant invention have, in some cases, structural and functional similarities to teachings separately set forth in the prior art disclosures heretofore cited and briefly discussed. However, as will hereinafter be pointed out, the instant invention is distinguishable from said earlier inventions in one or more ways in that the present invention has utility features and new and useful advantages, applications, and improvements in the art of vehicular mounted articulated aerial lift and ladder assemblies not heretofore known.

SUMMARY OF THE INVENTION

It is the principal object of the present invention to provide a vehicular mounted, multiply-articulated aerial lift and ladder assembly comprised of pivotally connected motor driven main and auxiliary ladder members with a pivotally connected partially enclosed man-carrying platform member affixed to the end thereof and incorporating design features which provide for a combination of mechanically automatic as well as mechanically powered horizontal levelling capabilities for said platform member, wherein, hydraulically activated longitudinal extension of the main ladder member or hydraulically activated arcuate deflection of the auxiliary ladder member will not affect the horizontal orientation of said platform member, however, upon hydraulically activated arcuate deflection of said main ladder member occurring the horizontal orientation of said platform assembly may be continually compensated for and maintained by simultaneously activating an electrical motor driven jack screw levelling means during vertically arcuate displacement of said main ladder member to the desired operative angular elevation relative to the ground plane.

It is another object of the present invention to provide remotely controlled motor driven mechanically articulated motion capabilities which will enable the safe and accurate positioning of a man within said platform member at an extended aerial location within the workable range of said lift and ladder assembly.

It is a further object of the present invention not only to provide a lift and ladder assembly which is vertically extensible, but additionally is horizontally extensible and rotatably displaceable.

Still another object of the present invention is to provide a sturdy vehicular mounting and support structure assembly for said lift and ladder assembly which will enable optimum utilization of vehicle cargo-carrying space and capacity.

It is yet another object of the present invention to provide a sturdy vehicular lift and ladder assembly mounting and support structure assembly which is both easily installed and easily removed.

An additional object of the present invention is to provide a sturdy vehicular mounting and support structure assembly, which, in combination with said lift and ladder assembly, will permit the ease of loading tools within, and mounting of, the platform member of said lift and ladder assembly while the same is in stowed position upon the vehicle.

A further object of the present invention is to provide a multiply articulated aerial lift and ladder assembly and vehicular mounting support structure which is relatively simple and less expensive than currently available equipment having comparable capabilities.

DETAILED DESCRIPTION OF THE INVENTION

Figure 1:
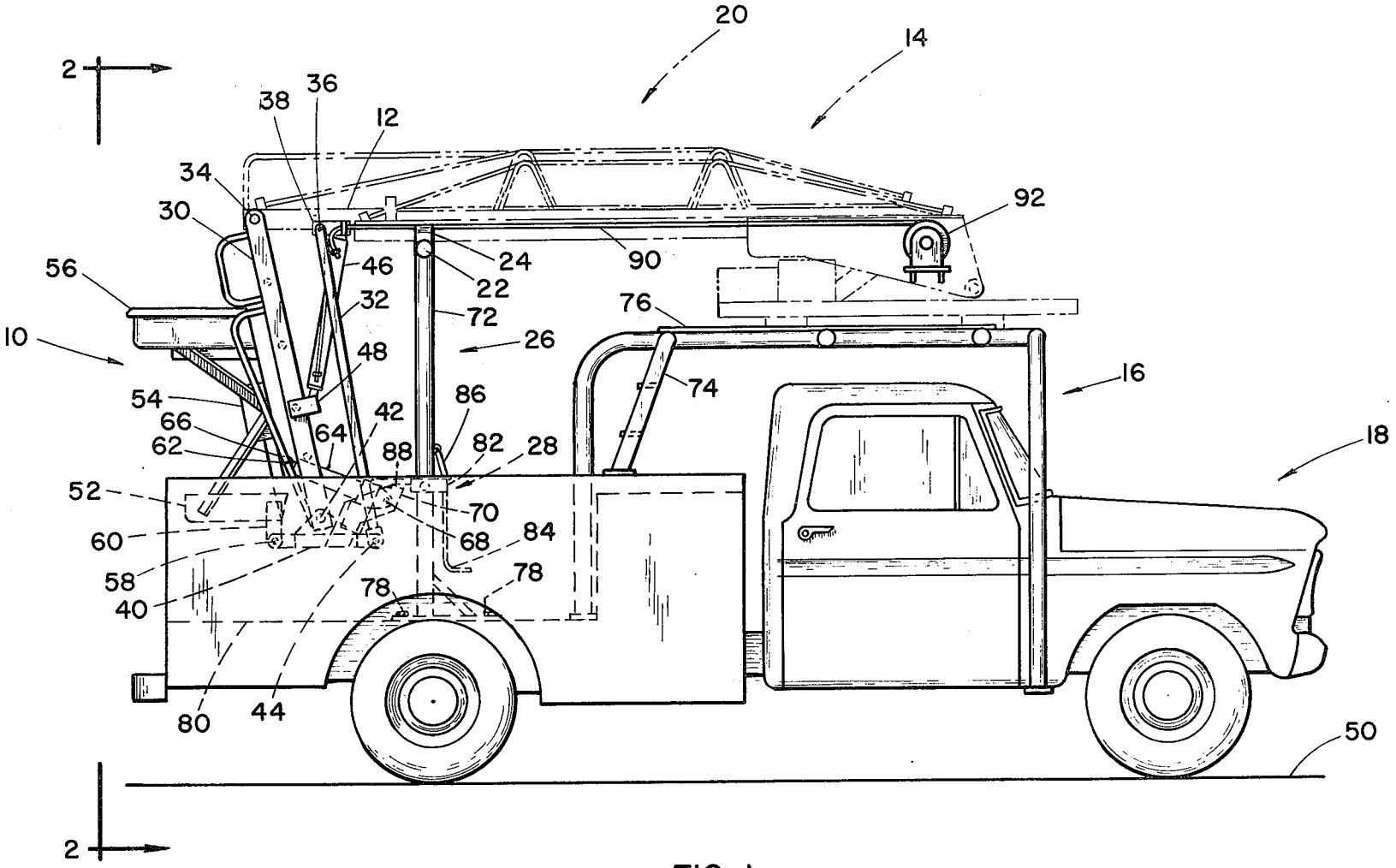
FIG. 1 is a side elevation of an auxiliary extension member installed upon a vehicular mounted aerial ladder assembly, with the unit being shown in a stowed vehicular transport position upon and secured to the stowed ladder support frame.

Referring to FIG. 1, the present invention, shown in a stowed vehicular transport position, comprises an auxiliary extension member 10 which is pivotally affixed to the extensible ladder section 12 of an aerial ladder assembly 14, which in turn is rotatably mounted upon a main support frame 16 detachably installed upon an exemplary service vehicle 18, with aerial ladder members 20 of said assembly 14 extending rearward of said vehicle 18 and resting upon the horizontal support member 22 between flange ears 24 of the stowed ladder support frame 26 which is likewise detachably affixed to said vehicle 18, with said auxiliary extension member 10 being secured for transport by means of latch assembly 28.

Referring again to FIG. 1 to describe in greater detail the component parts of this invention as well as explain the operation thereof, the auxiliary extension member consists primarily of two functional groups, each being extensibly operable by separate and independently controlled drive means. The first functional group is made up of a linked parallel bar assembly comprising an auxiliary ladder section 30 and a set of parallel members 32. The auxiliary ladder section 30 is pivotally connected at the upper stowed position ends thereof to the upper end of extensible ladder section 12 at pivot points 34, while each of the parallel members 32 is respectively pivotally connected at the upper stowed position ends thereof at pivot points 36 to bracket members 38 which are in turn stationarily affixed to extensible ladder section 12 such that the respective center-to-center distances between pivot points 34 and 36 on either side of extensible ladder section 12 are dimensionally equal. The lower respective ends of ladder section 30 are pivotally connected to plates 40 at pivot points 42, while the lower respective ends of parallel members 32 are pivotally connected to plates 40 at pivot points 44, such that the respective center-to-center distances between pivot points 42 and 44 are equal to the center-to-center distances between pivot points 34 and 36. With the first functional group having a pivotally linked construction as heretofore described, one is thereby enabled to longitudinally extend the extensible ladder section 12 and/or arcuately extend said first functional group assembly of the auxiliary extension member by means of hydraulic piston 46 pivotally attached at the upper stowed position end thereof to bracket member 38 on extensible ladder section 12 and, at the piston rod end thereof is pivotally attached to bracket 48 which is stationarily affixed to the auxiliary ladder section 30, and in so doing, the second functional group, comprised of a pivotally affixed man-carrying platform assembly, will essentially maintain a configuration whereby the base of said platform remains horizontal and parallel to ground level 50.

The second functional group of the auxiliary extension member 10 is made up of a platform assembly comprised of a platform base 52 which has affixed thereto a partially enclosing frame work structure 54 which in turn supports a work bench member 56 wherein are mounted the power and control switches to operate the integrated electrical and hydraulic circuits whereby the auxiliary extension member 10 and the aerial ladder assembly 14 are articulated to position a man at an elevated and/or extended work position. The work bench member 56 also provides a working surface as well as providing a place to stow and carry tools aloft. The platform assembly is pivotally attached to plates 40 at pivot points 58 by means of brackets 60 stationarily affixed to the platform base 52, as well as also being pivotally attached at pivot point 62 to an electric motor driven jack screw 64 by means of bracket 66 stationarily affixed to a frame work structure member. The motor end of jack screw 64 is pivotally connected at pivot point 68 to a mounting member 70. By means of this second functional group of the auxiliary extension member, being pivotally connected as heretofore described, an operator in the platform assembly, by activating the electrically powered jack screw 64, is enabled to continuously and simultaneously tilt and maintain the base of said platform in a horizontal position relative to the grou n d level 50 upon vertically arcuate displacement, either up or down, of the aerial ladder assembly 14 through its full range of vertically arcuate displacement. Therefore, the mechanically linked pivotal combination of the aforementioned two functional groups, powered by their respective drive means, enables full control by an individual occupying the platform assembly, of the orientation and configuration of the platform assembly irrespective of whether the auxiliary extension member 10 is arcuately extended, or the aerial ladder assembly 14 is extended or retracted, arcuately displaced up or down in a vertical plane, or rotationally displaced in a horizontal plane by means of the rotary deck plate member of the aerial ladder assembly, or a series of movements comprised of a compound combination of the aforementioned articulations. In addition to the aforementioned adjustability of the angle of the extensible aerial ladder assembly 14 relative to platform base 52, the angular positioning of auxiliary ladder section 30 relative to the assembly 14, and the levelling of platform base 52 to a desired horizontal position by means of jack screw 64, it will be seen from the foregoing that an important feature of the invention comprises the fact that, after an operator has established the desired angle of the assembly 14 at which he wishes to work, he may thereafter vary the angle of the auxiliary ladder section 30 relative to the upper end of assembly 14 by activating hydraulic piston 46 in the desired direction and the platform base 52 automatically will remain horizontal by the function of the linkage assembly comprised of auxiliary ladder section 30 and parallel members 32.

Additionally shown in FIG. 1 are the main support frame 16, the stowed ladder support frame 26, and the latch assembly 28 which is affixed to the stowed ladder support frame main vertical post member 72. Support frame members 16 and 26 enable the combined aerial ladder and auxiliary extension member assemblies to be operationally installed upon and transported by an exemplary service vehicle 18 in such a manner so as to insure optimum utility of available vehicle cargo space and to further provide easy access to, and personnel entry of, the platform assembly. The support frame assemblies are constructed of a suitable tubular stock material sufficient in size and weight to provide for sturdy and safe transport and aerial ladder and auxiliary extension member operation. The main support frame 16 is further provided with access steps 74 and a catwalk 76 for ease of personnel entry to or from the aerial ladder assembly in emergency or assist situations. Both of the support frame assemblies are affixed to the service vehicle body by means of bolts 78 for ease of installation and removal as it has been generally found that aerial ladder assemblies of the type herein shown have an operational life considerably in excess of that of the vehicle upon which they are normally installed.

Figure 2:
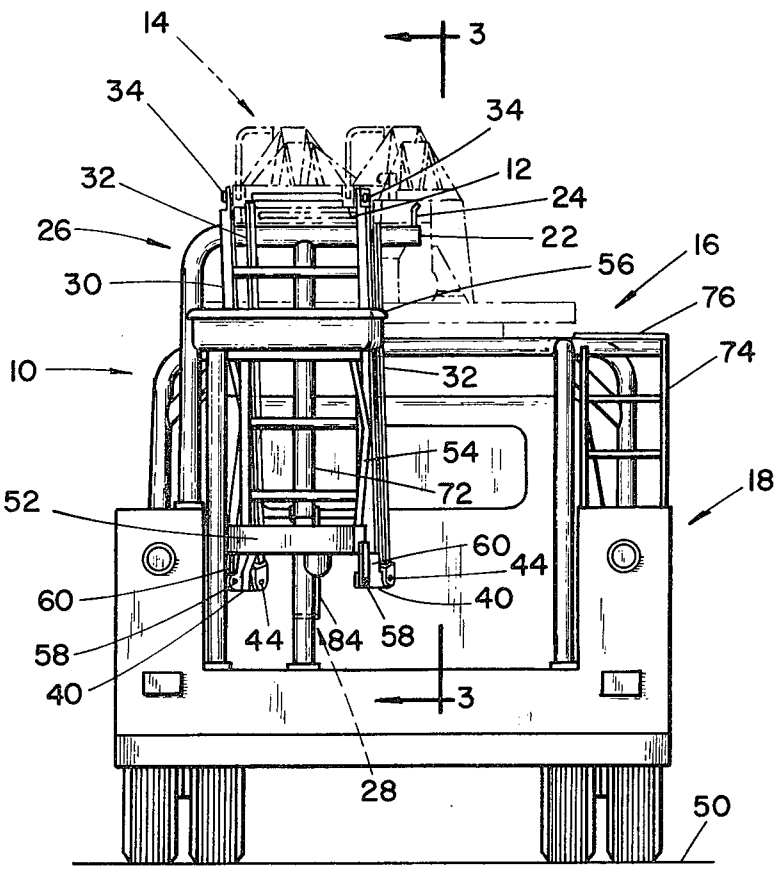
FIG. 2 is an end elevation of the view shown in FIG. 1 as seen on the line 2 — 2 thereof.

The stowed ladder support frame shown in FIG. 1, as it will be noted by reference to FIG. 2, is installed so as to support the aerial ladder assembly and auxiliary extension member to one side of the service vehicle cargo bed 80, the purpose being to provide for ease of access to, and maximum utility of, available cargo space. Attached to the stowed ladder support frame is latch assembly 28, comprised of a mounting bracket 82, foot release lever 84, a return spring 86, and pivoted catch 88, wherein the catch 88 engages the mounting member 70 to secure the auxiliary extension member when in the stowed transport position as shown.

It should further be noted, as shown in FIG. 1, the hydraulic piston 46 is supplied with fluid from the main hydraulic reservoir of the aerial ladder assembly through hydraulic line 90 which is automatically paid out from the spring loaded hose drum 92 upon ladder elevation and extension, and automatically rewound upon ladder lowering and retraction.

The auxiliary extension member 10 as disclosed in FIG. 1 may be constructed of metal, plastic, wood, or any other suitable materials or a combination thereof.

In FIG. 2 an end view of the side elevation shown in FIG. 1, as seen along the line 2 — 2 thereof, is detailed wherein there is seen the lateral configuration of support frame members 16 and 26 installed upon the exemplary service vehicle 18, as well as the configuration of the auxiliary extension member 10 affixed to the aerial ladder assembly when both of the same are in the stowed vehicular transport position.

Figure 3:
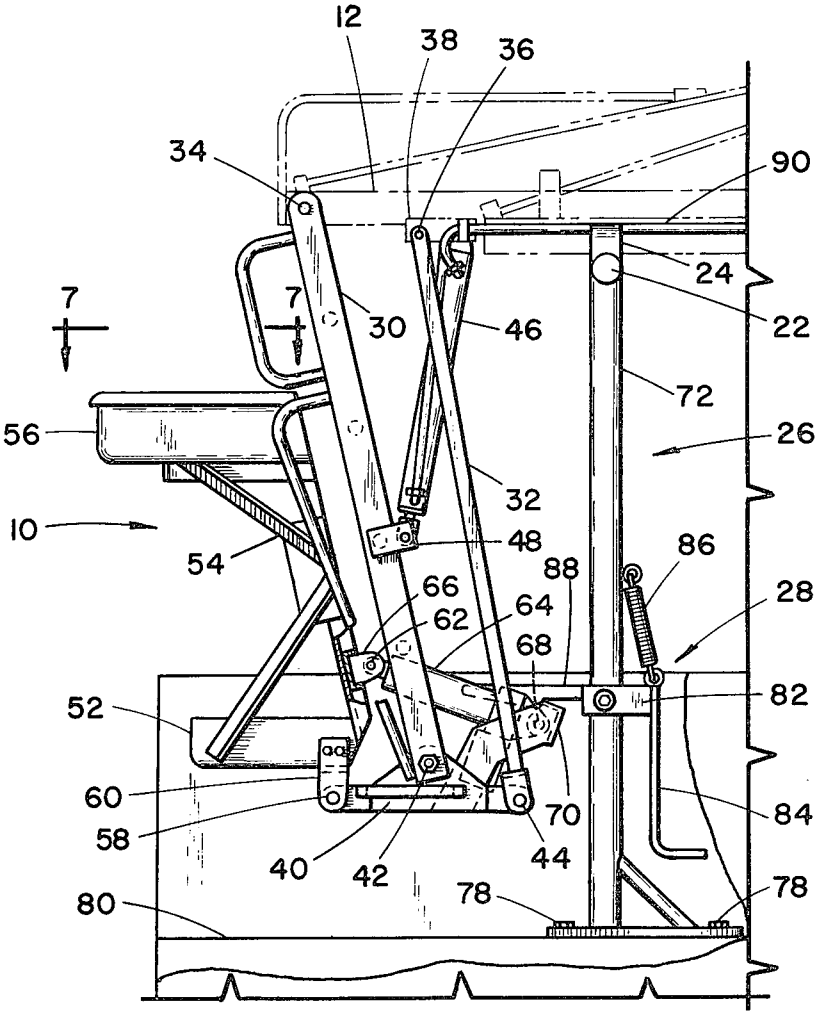
FIG. 3 is an enlarged fragmentary side view of the auxiliary extension member as shown in FIG. 2 and seen on the line 3 — 3 thereof.

In FIG. 3 a fragmentary enlarged side elevation as shown in FIG. 1, but seen along the line 3 — 3 of FIG. 2, is presented to disclose greater structural and assembly detail of the auxiliary extension member as well as the stowed ladder support frame 26 and the latch assembly 28 affixed thereto.

Figure 4:
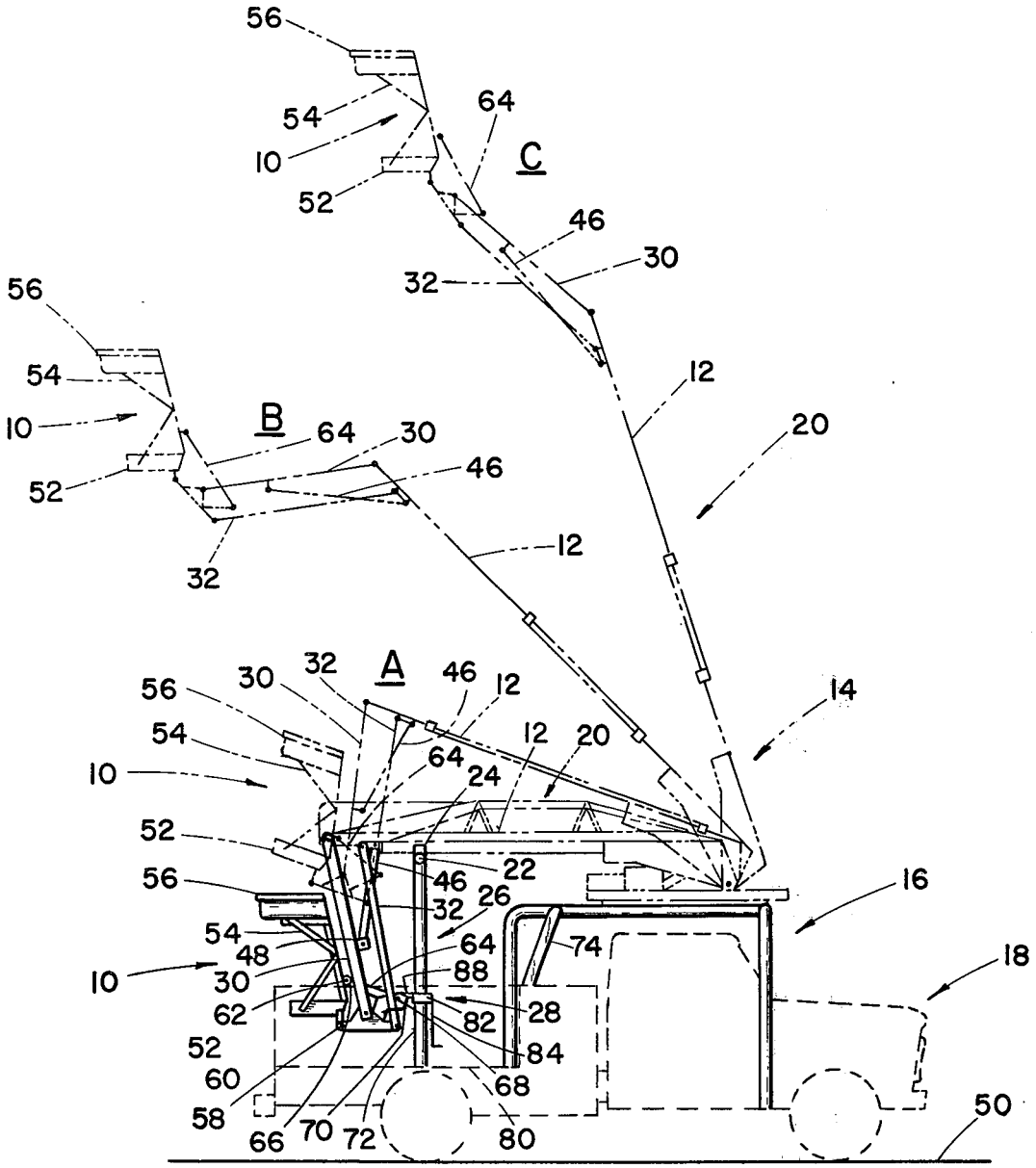
FIG. 4 is a simplified side elevation of the vehicular mounted unit as shown in FIG. 1, but also showing phantom views of various positions of elevation and extension of said unit between the stowed vehicular transport position and maximum operational elevation.

The alternate disposition views shown in FIG. 4 present a series of simplified side elevations wherein are seen exemplary elevation and extension configurations which are possible with the vehicularly installed aerial ladder assembly having an auxiliary extension member affixed thereto in accordance with the foregoing descriptions as well as will those hereinafter set forth. The initial position is that of the ladder assemblies in the vehicular transport position as they are when the equipment arrives at a job site. The position seen in view A of FIG. 4 shows the aerial ladder assembly after having been arcuately elevated through a relatively small angle of vertical deflection with no aerial ladder extension. At this point a person occupying the platform assembly can activate the jack screw motor to extend the jack screw 64 and bring the platform base 52 into horizontal alignment relative to the ground level 50. It should be noted that a reasonably skilled person would be able to simultaneously coordinate the operation of multiple control switches and maintain his relative horizontal alignment while performing simultaneous multiple articulation functions with the ladder assemblies.

The position seen in view B of FIG. 4 shows the aerial ladder assembly after having been arcuately elevated through a moderate angle of vertical deflection and aerial ladder assembly extension, in addition to arcuate displacement of the auxiliary ladder section 30 as well as extension of the jack screw 64, wherein the jack screw extension has been employed to maintain position of the platform assembly in a relative horizontal configuration to ground level 50. The position seen in view C of FIG. 4 is similar to that seen in view B, except that the entire ladder assembly has been extended through its maximum intended vertically arcuate deflection to the maximum elevation, and showing the jack screw 64 at maximum extension to maintain the platform assembly in a horizontal reference parallel to ground level.

Figure 5:
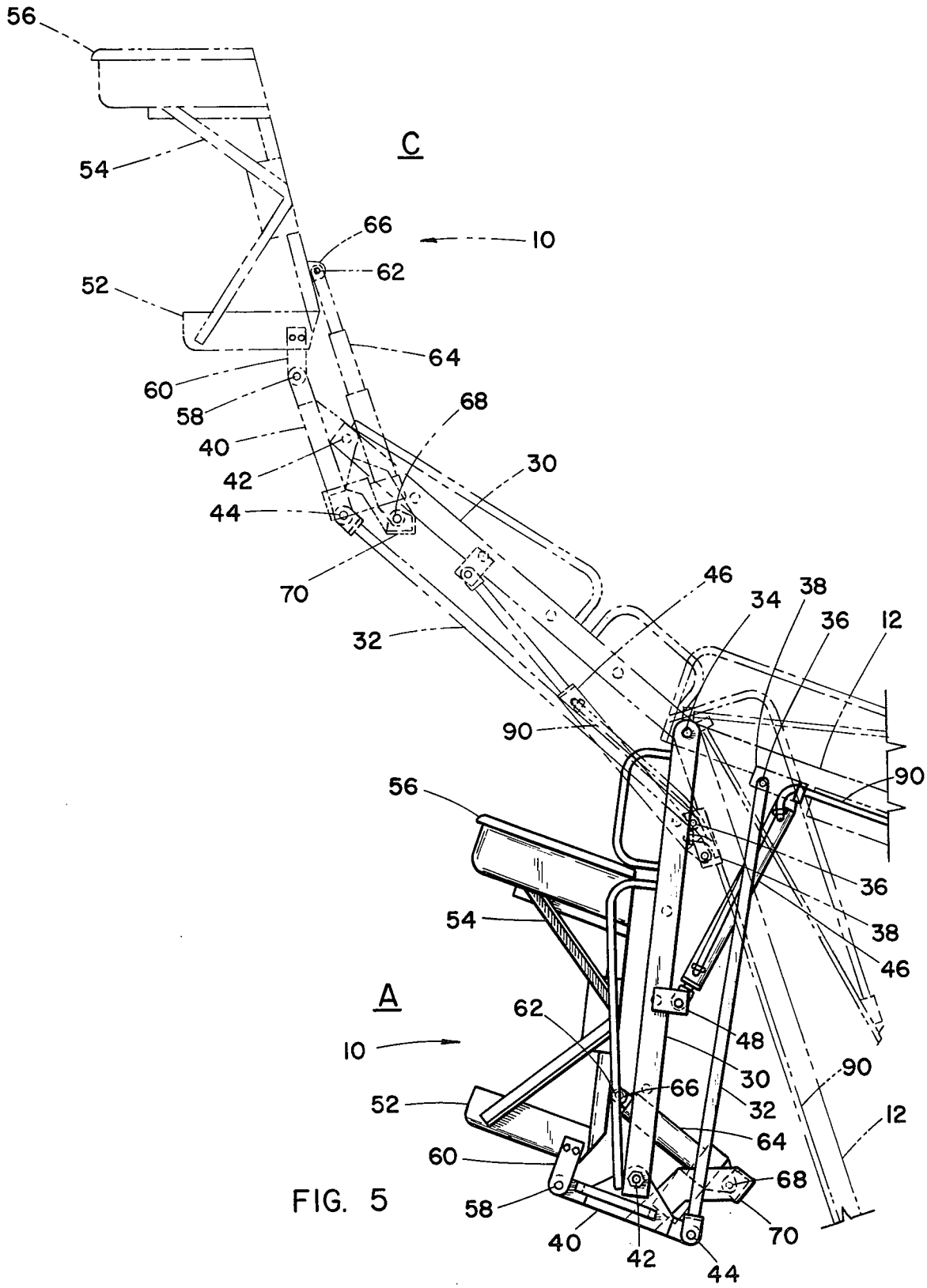
FIG. 5 is a detailed enlarged fragmentary side elevation of two of the elevated and extended views of said unit as shown in FIG. 4.

In FIG. 5 there is presented enlarged fragmentary alternate detail views corresponding to the auxiliary extension member configurations shown in the simplified views A and C of FIG. 4, wherein is seen exemplary different configurations of the extension and pivotal linkages whereby the platform assembly may be horizontally maintained as heretofore described.

Figure 6:
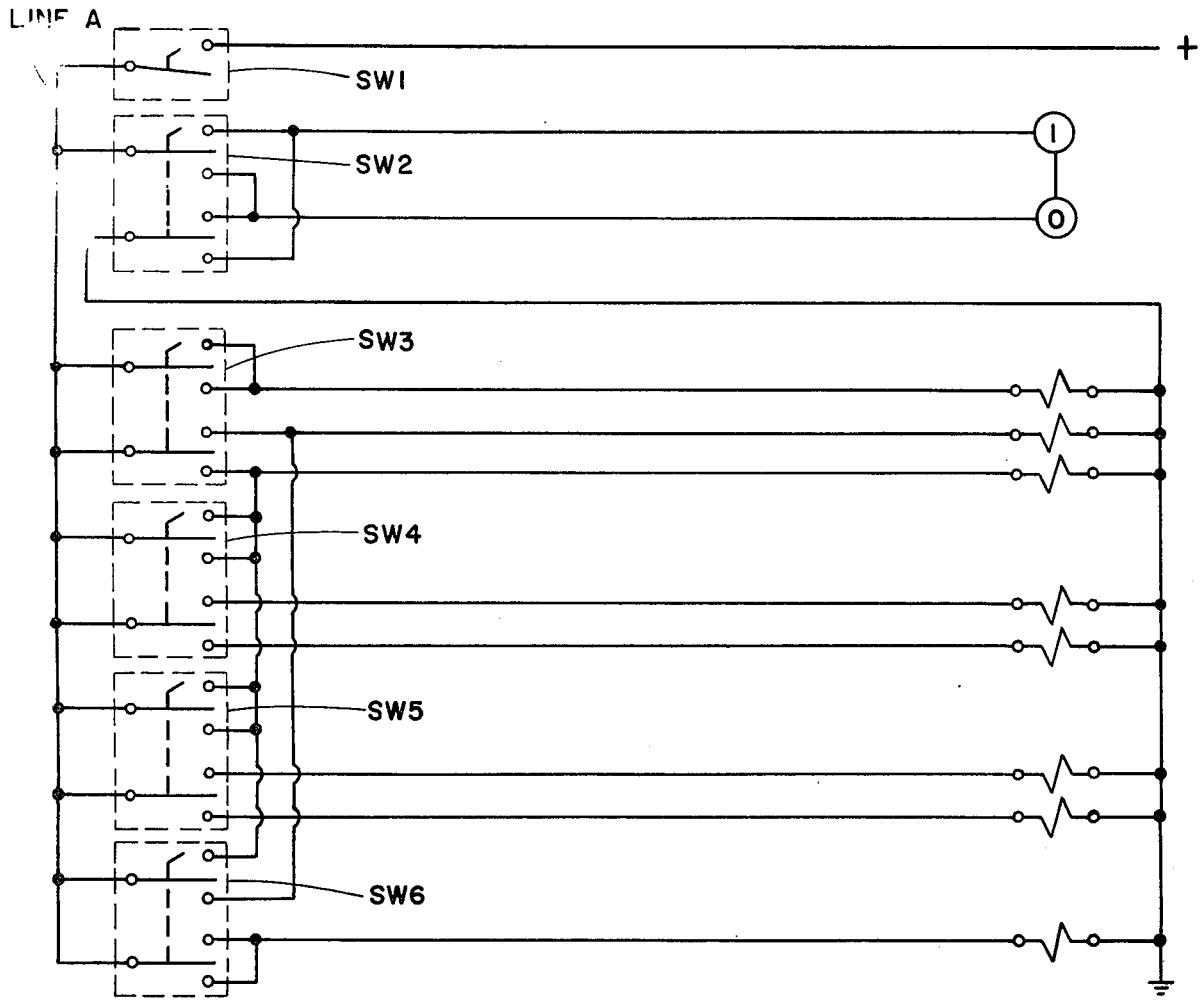
FIG. 6 is a schematic diagram of the integrated electrical and hydraulic circuits whereby the articulating function powering means for said unit are activated and controlled.
Figure 7:
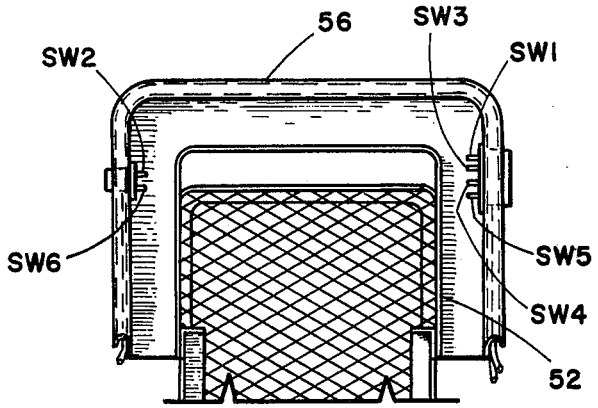
FIG. 7 is an enlarged plan view of the auxiliary extension member platform, as seen along the line 7 — 7 of FIG. 3, showing locations thereon of the electrical and hydraulic circuit control switches.

The diagram shown in FIG. 6 is a schematic of the integrated electrical and hydraulic circuits by which the ladder assembly 14 is powered and directionally displaced, which circuits incorporate a dual location control console system whereby the aerial ladder assembly may be selectively positioned by either an operator occupying the platform assembly through means of the first control console directional displacement switches mounted in the work bench member 56 thereof as shown in FIG. 7, or alternately by a remote operator through means of a set of second control console directional displacement switches not shown, but, however, positioned at a ground level mounting upon the service vehicle 18. The second control console at a ground level location additionally provides, by means of a safety over-ride circuit, the ability to cut out power to the platform location first control console and thereby enable ground position displacement of the ladder assembly in the event of an emergency or rescue situation, such as a platform positioned operator in some manner being injured or otherwise incapacitated.

The main power switch SW-1, as shown in the FIG. 6 circuit schematic, is a simple pull "on" and push "off" switch which when in the "on" position provides positive circuit energizing of the control console directional displacement switches SW-2, SW-3, SW-4, SW-5, and SW-6 through Line A as also shown in the FIG. 6 circuit schematic. Switch SW-2 is, as are all remaining switches in the control circuit, a double-pole/double-throw/spring return to center switch, and is employed to energize positive and negative circuits which activate the bi-directional jack screw electrical motor for maintaining horizontal control of the platform assembly upon vertically arcuate displacement of the aerial ladder assembly 14. When held in closed position in one direction SW-2 energizes the forward windings in the bi-directional jack screw motor and the screw 64 is extended out from the jack housing, as indicated by "O" on the schematic. When SW-2 is held in the closed position in the opposite direction the reverse windings in the bi-directional jack screw motor are energized and the screw 64 retracts as indicated by "I".

Vertical arcuate up and down displacement of the aerial ladder assembly 14 is accomplished with switch SW-3, which when activated in the elevation direction energizes a solenoid switch on the electric motor which drives the hydraulic pump while concurrently energizing the solenoid which opens the normally closed elevation safety valve thereby allowing pressurized hydraulic fluid entry to the elevation cylinder and extension of the lift piston which also thereby effects vertically arcuate elevation of the aerial ladder assembly. Activating switch SW-3 in the lowering direction energizes the solenoid which opens the normally closed elevation safety valve while concurrently energizing that solenoid which opens the pump mounted release valve, thereby releasing pressure in the elevation cylinder and enabling the lift piston to retract which also thereby effects vertically arcuate lowering of the aerial ladder assembly.

Horizontal left and right rotary displacement of the aerial ladder assembly 14 is controlled by switch SW-4, which when activated in one position energizes the solenoid switch on the electric motor which drives the hydraulic pump while concurrently energizing the solenoid which opens the normally closed left rotation valve thereby admitting pressureized hydraulic fluid to the bi-directional hydraulic rotation motor and effecting a rotary left directional displacement of the aerial ladder assembly. Activating switch SW-4 in the opposite direction simultaneously energizes the hydraulic pump electric motor solenoid as well as the solenoid which opens the normally closed right rotation valve thereby admitting pressurized hydraulic fluid to the opposite side of the bi-directional hydraulic rotation motor and effecting a rotary right directional displacement of the aerial ladder assembly.

The switch employed to control extension and retraction of the aerial ladder assembly 14 is SW-5, which when activated in the extension position energizes the hydraulic pump motor solenoid and concurrently the solenoid which opens the extension valve of an extension and retraction hydraulic motor, thereby enabling pressurized hydraulic fluid to rotate said extension and retraction hydraulic motor in the direction of extension and operate the chain drive whereby the aerial ladder assembly is extended. Activation of SW-5 to the retraction position simultaneously energizes the hydraulic pump motor solenoid and the retraction valve solenoid of the extension and retraction hydraulic motor, thereby enabling pressurized hydraulic fluid to rotate said extension and retraction hydraulic motor in the direction of retraction and operate the chain drive whereby the aerial ladder assembly is retracted.

The last control switch is SW-6 and is employed to operate the extension ladder hydraulic piston 46 for accomplishing arcuate displacement of the platform assembly by means of the auxiliary extension member 10. Activation of switch SW-6 in one direction energizes the hydraulic pump motor solenoid and concurrently energizes the solenoid which opens the normally closed hydraulic piston 46 safety valve thereby enabling pressurized hydraulic fluid to enter the cylinder of piston 46 and cause said piston to extend, and also thereby effecting arcuate extension of the platform assembly. Activation of switch SW-6 in the opposite direction energizes the normally closed hydraulic piston 46 safety valve solenoid and opening said safety valve, as well as simultaneously energizing that solenoid which opens the pump mounted release valve, thereby enabling pressurized hydraulic fluid to escape from the cylinder of piston 46, and upon the resultant retraction of said piston likewise effect arcuate retraction of the platform assembly.

The view seen in FIG. 7 is an enlarged top plan drawing of the platform assembly as shown along the line 7 — 7 of FIG. 3, and shows the relative positions and identifications of the various control switches heretofore described and discussed.

While the invention has been described and illustrated in its several preferred embodiments, it should be understood that the invention is not to be limited to the precise details herein illustrated and described since the same may be carried out in other ways falling within the scope of the invention as illustrated and described.

I claim:

1. A vehicular mounted multiply-articulated extensible aerial ladder assembly to support a person at an elevated working position comprising, base means attachable to a vehicle, a plurality of rigid elongated ladder members longitudinally extensible relative to each other, one end of one of said ladder members being pivotally and rotatably connected to said base means and another of said ladder members being extensible and retractable relative to said one of said ladder members, and power means on said base means connected to said one of said ladder members and operable to arcuately move the same angularly from a substantially horizontal inoperative position on said base means to an operative position at an obtuse angle to the horizontal position, an auxiliary extension platform assembly support frame comprised of an auxiliary extension ladder member and a plurality of spaced link means the same being respectively pivotally connected at one end thereof to the outer end of said another ladder member and movable between an initial position substantially perpendicular thereto to a position at an obtuse angle thereto, a platform assembly pivotally connected to the opposite end of said auxiliary extension ladder member and said link means the same being substantially equally spaced from and parallel to said auxiliary extension ladder member and mutually cooperative with said auxiliary extension ladder member to rigidly support and maintain said platform assembly substantially in the same relative plane in all positions of angular adjustment of said auxiliary extension platform assembly support frame and longitudinal extension and retraction of said another of said ladder members and upon vertically arcuate angular adjustment of said auxiliary extension platform assembly support frame, in combination with auxiliary extension platform assembly support frame drive means comprised of a fluid operated cylinder unit extending between and connected at opposite ends thereof respectively to said auxiliary extension ladder member intermediately of its ends and the outer end portion of said another of said ladder members, said cylinder unit beng operable to move said auxiliary extension ladder member from a substantially vertically inoperative position to an operative position at an obtuse angle to said another of said ladder members, and further including a longitudinally extensible and contractable jack screw connected at opposite ends thereof respectively to the outer end portion of said auxiliary extension ladder member and the base of said platform, and operable to simultaneously maintain said platform substantially in said same relative plane through all positions of obtuse angular adjustment of said rigid elongated ladder members.

2. A vehicular mounted multiply-articulated extensible aerial ladder assembly in accordance with claim 1 whereby said jack screw is operable when said auxiliary extension ladder member is in a substantially vertical inoperative position, thereby enabling tilting of said platform for ease of equipment loading and personnel entry while said multiply-articulated extensible aerial ladder assembly is in an otherwise inoperative stowed position upon said vehicle.

3. A vehicular mounted multiply-articulated extensible aerial ladder assembly in accordance with claim 1 further including a support structure detachably affixed to said vehicle, wherein said base means and aerial ladder assembly in the stowed vehicular transport configuration enables ease of access to, and optimum utilization of, the available cargo carrying capacity of said vehicle.

* * * * *